US005626393A

United States Patent [19]

Levasseur et al.

[11] Patent Number: 5,626,393

[45] Date of Patent: May 6, 1997

[54] FOOTREST

[76] Inventors: Leon E. Levasseur; Leon J. Levasseur, both of 50 Whitney St., Holliston, Mass. 01746

[21] Appl. No.: 519,884

[22] Filed: Aug. 28, 1995

[51] Int. Cl.[6] ..... A47C 16/02

[52] U.S. Cl. ..... 297/423.46; 297/423.42; 297/423.45; 248/425; 108/1; 108/8; 108/157

[58] Field of Search ..... 297/423.46, 258.1, 297/261.1, 325, 329, 423.42, 423.45; 108/1, 8, 157; 248/125, 423; 403/320, 319, 315, 108, 106, 104

[56] References Cited

U.S. PATENT DOCUMENTS

| | | | |
|---|---|---|---|
| 2,850,081 | 9/1958 | Dillon | 297/423.46 X |
| 3,653,715 | 4/1972 | Drabert et al. | 297/423.45 |
| 3,806,193 | 4/1974 | Faiks | 297/325 |
| 4,441,758 | 4/1984 | Fleisher et al. | 297/423.46 |
| 4,873,966 | 10/1989 | Gitter | 297/423.46 X |
| 4,901,385 | 2/1990 | Adolphson | 297/423.46 X |
| 5,294,180 | 3/1994 | Grimm | 297/423.46 X |
| 5,348,377 | 9/1994 | Grosch | 297/423.46 X |
| 5,356,203 | 10/1994 | Levasseur et al. | 297/423.45 |
| 5,419,618 | 5/1995 | Hatcher | 297/423.46 |

FOREIGN PATENT DOCUMENTS

| | | | |
|---|---|---|---|
| 1278370 | 10/1961 | France | 297/423.46 |

*Primary Examiner*—Peter M. Cuomo
*Assistant Examiner*—Rodney B. White
*Attorney, Agent, or Firm*—John E. Toupal; Harold G. Jarcho

[57] ABSTRACT

A footrest including a frame having a base portion for placement on a supporting surface and a standard portion projecting upwardly from the base portion. The standard portion has a pair of substantially parallel horizontally spaced apart uprights, and a pair of substantially parallel horizontally spaced apart struts, each strut having an upper end joined to an upper end of a different one of the uprights by a joining portion and the joined uprights and struts sloping upwardly toward each other. Also included in the footrest is a platform defining a substantially planar surface straddled between the joining portions and having edge portions disposed adjacent to the joined uprights and struts; and a support mechanism engaged between each of the edge portions and the adjacent joined upright and strut, each support mechanism having an upright support slidably engaged between the adjacent upright and the platform and a strut support spaced from the upright support and slidably engaged between the adjacent strut and the platform. Each support mechanism is shaped and arranged to permit upward movement of the platform with respect to the frame and includes an adjustment mechanism allowing adjustment of the spacing between each pair of the spaced apart upright and strut supports.

20 Claims, 4 Drawing Sheets

FOOTREST

BACKGROUND OF THE INVENTION

This invention relates to a footrest and, more particularly, to a vertically adjustable footrest.

Persons sitting in chairs at desks, work tables and the like often use footrests for leg support. Such footrests have been developed in a wide variety of forms. A deficiency of most prior footrests resides in their use of a foot support surface that cannot be vertically adjusted to a supporting frame so as to suit the preference of the user. Improved footrests with vertically adjustable foot support surfaces are disclosed in U.S. Pat. Nos. 3,132,835 and 5,356,203. However, those footrests also suffer from various disadvantages including high cost, limited adjustability and lack of flexibility.

The object of this invention, therefore, is to provide an improved footrest which is vertically adjustable.

SUMMARY OF THE INVENTION

The invention is a footrest including a frame having a base portion for placement on a supporting surface and a standard portion projecting upwardly from the base portion. The standard portion has a pair of substantially parallel horizontally spaced apart uprights, and a pair of substantially parallel horizontally spaced apart struts, each strut having an upper end joined to an upper end of a different one of the uprights by a joining portion and the joined uprights and struts sloping upwardly toward each other. Also included in the footrest is a platform defining a substantially planar surface straddled between the joining portions and having edge portions disposed adjacent to the joined uprights and struts; and a support mechanism engaged between each of the edge portions and the adjacent joined upright and strut, each support mechanism having an upright support slidably engaged between the adjacent upright and the platform and a strut support spaced from the upright support and slidably engaged between the adjacent strut and the platform. Each support mechanism is shaped and arranged to permit upward movement of the platform with respect to the frame and includes an adjustment mechanism allowing adjustment of the spacing between each pair of the spaced apart upright and strut supports. The adjustment mechanism can be used to adjust the vertical position of the platform on the standard portion.

According to one feature of the invention, upright support is an upright support pin and each strut support is a strut support pin, and the support pins are retained by one of the standard portion and the platform and are movable thereon. The pins can be moved to adjust the spacing between the supports.

According to another feature of the invention, the adjustment mechanism includes for each support pin a plurality of spaced apart receptacles. Spacing adjustment is accomplished by selection of specific receptacles for the pins.

According to still other features of the invention, the support pins are retained by the platform and the receptacles are defined thereby, the platform defines a pair of slots each having a pair of parallel edges forming one of the edge portions and receiving one pair of a joined upright and strut; and the receptacles include for each support pin a plurality of grooves formed on the platform on opposite sides of the slots, the grooves on one side of the slots being aligned with the grooves on the opposite side of the slots. These features simplify construction of the footrest.

According to further features of the invention, each of the grooves defines a longitudinal opening having a width less than the diameter of the support pin received thereby. The support pins must be forced into the grooves and are retained therein by a wire member hinged on the platform and slidably retaining the support pins.

According to a further feature, the invention includes a restraint for restraining separation of the platform from the frame. The restraint prevents inadvertent separation of the frame and platform.

According to an additional feature of the invention, the adjustment mechanism permits adjustments that provide one spacing between the upright support and the strut support adjacent to one of the edge portions, and a different spacing between the upright support and the strut support adjacent to an opposite side edge portion, and adjustments that provide for each pair of upright and strut supports an unequal spacing from a center of the adjacent edge portion. These features permit selection of inclined platform positions as desired.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
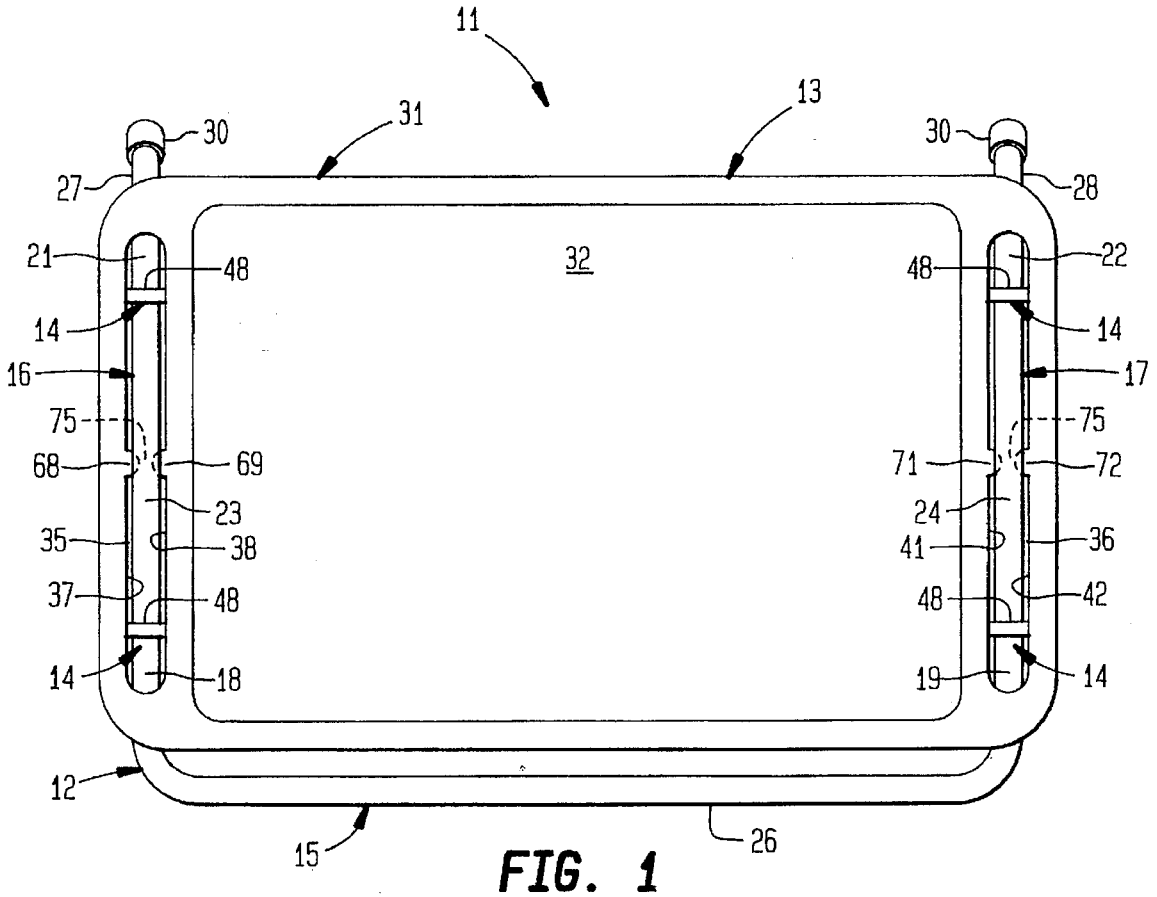
FIG. 1 is a top view of a footrest according to the invention.

A footrest 11 in accordance with the invention is illustrated in FIGS. 1–4. Included in the footrest 11 is a frame 12 formed with a uniform, continuous piece of tubing of diameter d; a platform 13 and a plurality of support assemblies 14 supporting the platform 13 on the frame 12. The frame 12 includes a base portion 15 and a pair of standard portions 16, 17 projecting upwardly therefrom. Forming standard portions 16, 17 are, respectively, a pair of parallel, horizontally spaced apart uprights 18, 19; a pair of parallel, horizontally spaced apart struts 21, 22; and a pair of upwardly curved members 23, 24 joining respectively, the upper ends of the upright 18 and strut 21 and the upright 19 and the strut 22.

Figure 2:
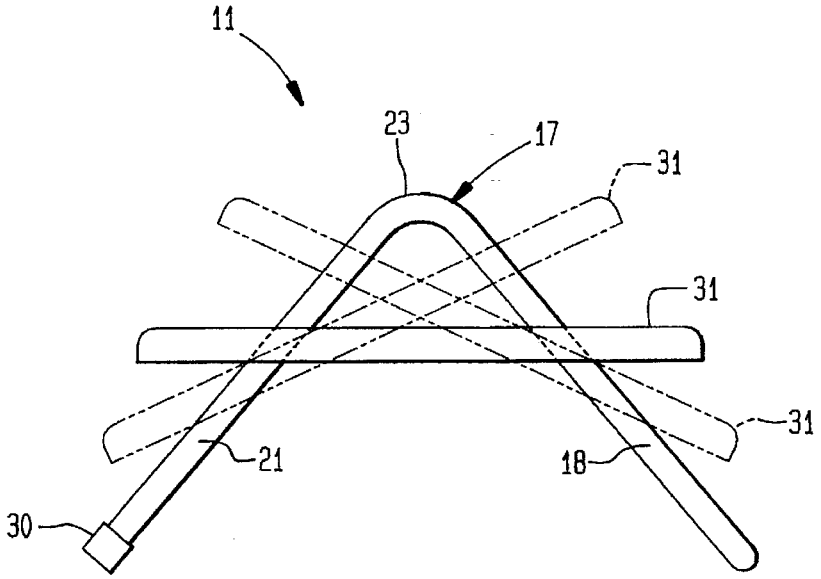
FIG. 2 is a side elevational view of the footrest shown in FIG. 1.

As shown in FIG. 2, the uprights 18, 19 slope upwardly in a given direction toward, respectively, the joined struts 21, 22; and the struts 21, 22 slope upwardly in a given direction toward, respectively, the joined uprights 18 and 19 to form two joined upright and strut pairs. Also formed by the frame 12 is an elongated member 26 extending between the bottom ends of the uprights 18, 19 and forming with free bottom ends 27, 28 of the struts 21, 22; the base portion 15 which is adapted for placement on a suitable supporting surface (not shown). The free ends 27, 28 are covered by caps 30.

The platform 13 is formed by a panel 31 having a planar upper support surface 32 straddled by the standard portions 17. Formed in the panel 31 are a pair of parallel, spaced apart slots 35, 36 which receive, respectively, the standard portions 16, 17. The slot 35 defines parallel edge portions 37, 38 that straddle the standard portion 16. Similarly, the slot 36 defines parallel edge portions 41, 42 that straddle the standard portion 17. The support assemblies 14 are disposed at corner portions on a bottom surface 44 of the panel 31.

Figure 3:
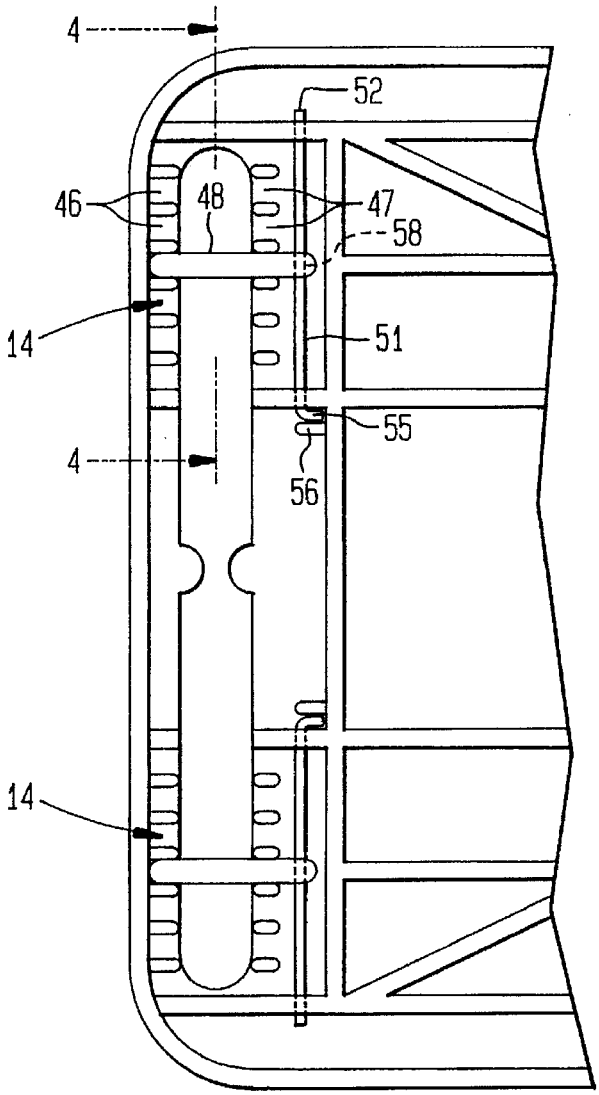
FIG. 3 is a detailed bottom view of a support assembly for the footrest shown in FIGS. 1 and 2.

Each of the support assemblies 14 includes a row of parallel spaced apart grooves 46 formed on one side of each slot 35, 36; a row of parallel spaced apart grooves 47 formed on an opposite side of each slot 35, 36 and a support pin 48. As shown in FIG. 3, the grooves 46, 47 extend transversely to the slots 35, 36 and are aligned on opposite sides thereof. Retaining each of the support pins 48 is an attachment wire 51 having one end 52 hinged to the bottom surface 44 and an opposite hooked end 55 detachably engageable with a latch 56. A hole 58 in one end of each support pin 48 slidably receives an attachment wire 51 so as to be longitudinally adjustable thereon.

Figure 4:
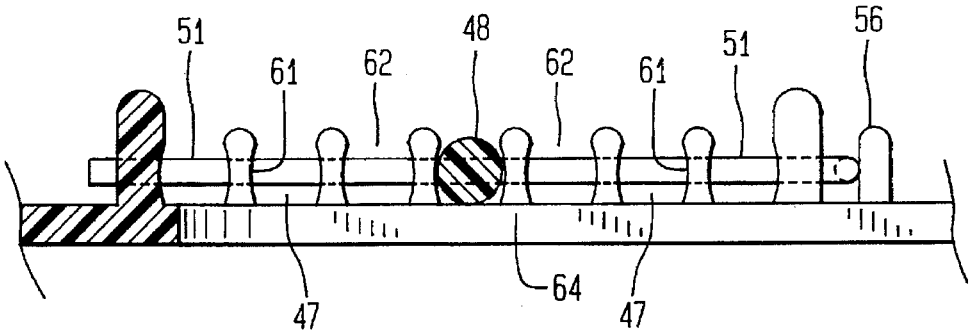
FIG. 4 is a cross-sectional view taken along lines 4—4 of FIG. 3.

As shown in FIG. 4, each of the grooves 46, 47 defines a semi-cylindrical recess 61 having a longitudinal opening 62 with a width less than the diameter of the support pin 48. The grooves 46, 47 are formed in a substrate 64 made of a resilient material that allows press fitting of the pins 48 into the openings 62 of the grooves 46, 47. Also formed by the substrate 64 are a pair of restraining projection portions 68, 69 and 71, 72 that extend transversely from, respectively, the edge portions 37, 38 and 41, 42. The projection portions 68, 69 and 71, 72 are disposed, respectively, in mid-portions of the slots 35, 36 and, as shown in FIG. 1, each pair of projection portions defines a gap 75 having a given length less than the diameter of the tubing forming the standard portion 17.

During use of the footrest 11, the platform 13 is positioned on the base 15 by press fitting the joining portions 23, 24, of, respectively, the standard portions 16, 17 through the gaps 75 and providing sliding supporting engagement of the support pins 48 by, respectively, the struts 21, 22 and uprights 18, 19 The pins 48 are slidable along the standard portions 16, 17 in the given directions in which the struts 21, 22 and uprights 18, 19 are joined. Because of the sliding engagement with the support pins 48, the platform 13 can be selectively oscillated into a desired orientation with respect to the base 15 as shown in FIG. 2. Also, the overall relative height of the platform 13 on the base 15 can be adjusted by changing the spacing between the support pins 48 in each of the slots 35, 36. The adjustment in spacing is obtained by selecting in each of the support assemblies 14 a predetermined aligned set of grooves 46, 47 for the support pins 48. Adjustment is accomplished by pivoting each of the pins 48 out of a retaining pair of grooves 46, 47, sliding the pin along the wire 51 into a position aligned with a newly selected pair of aligned grooves 46, 47, and then forcing the pin 48 into the selected grooves. Because of the projection portions 68, 69 and 71, 72, inadvertent separation of the platform 13 from the base 15 is prevented. However, desired separation of the platform 13 and base 15 can be obtained by merely forcing the joining portions 47, 41 of the standard portions 16, 17 through the gaps 75 between the projection portions 68, 69 and 71, 72.

Figure 5:
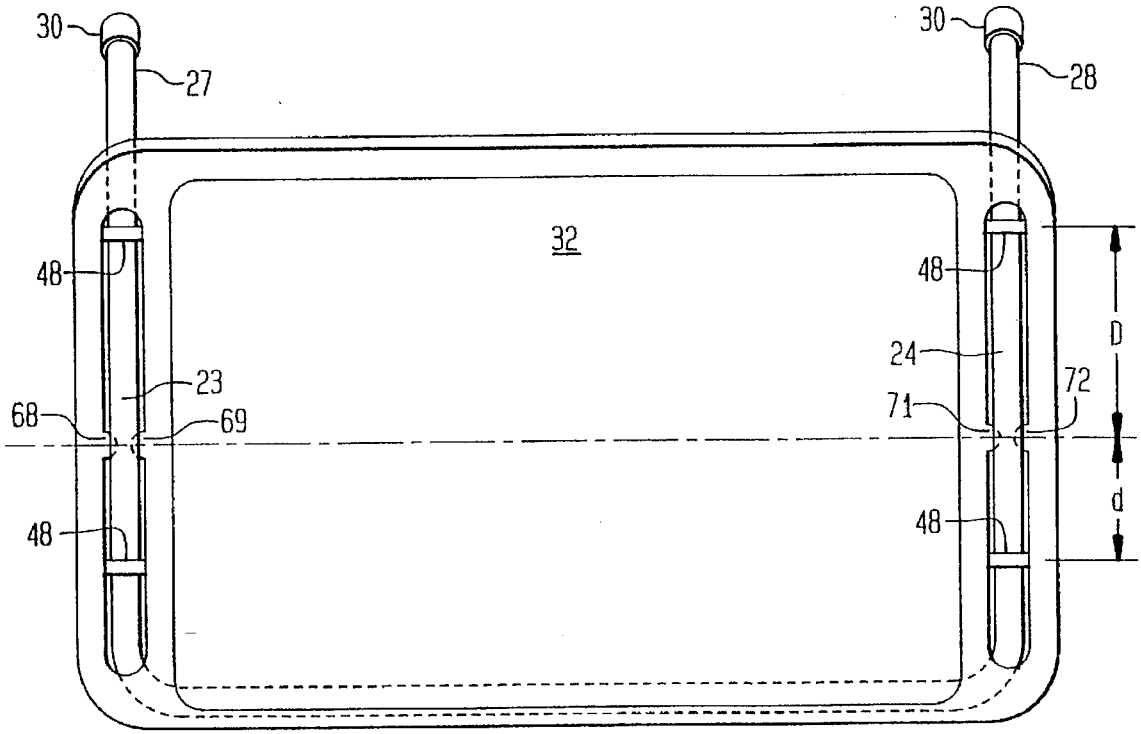
FIG. 5 is a top view illustrating a modified assembly for the footrest shown in FIG. 1.
Figure 6:
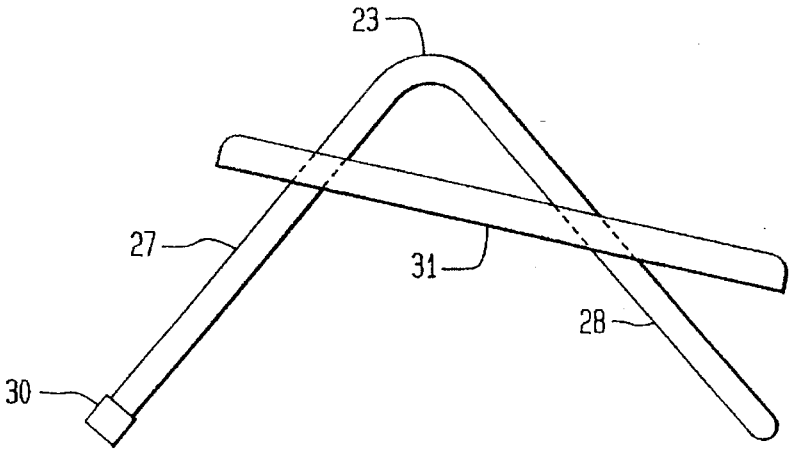
FIG. 6 is an elevational side view corresponding to the assembly shown in FIG. 5.

As shown in FIGS. 5 and 6, the support mechanisms 14 can be adjusted to provide a predetermined natural front to back inclination for the platform 13. By providing in each of the slots 35, 36 an unequal spacing d, D of the support pins 48 from a center point of the slot, the platform 13 will assume a predetermined natural inclination as shown in FIG. 6.

Figure 7:
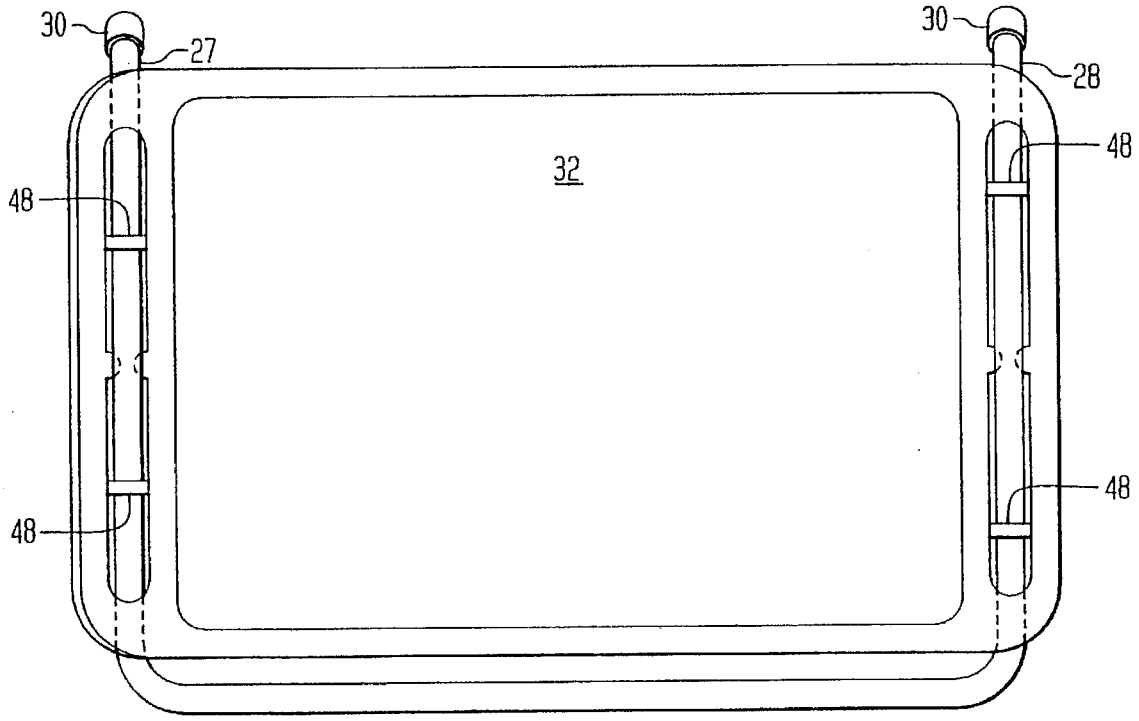
FIG. 7 is a top view illustrating another assembly adjustment of the footrest shown in FIG. 1.
Figure 8:
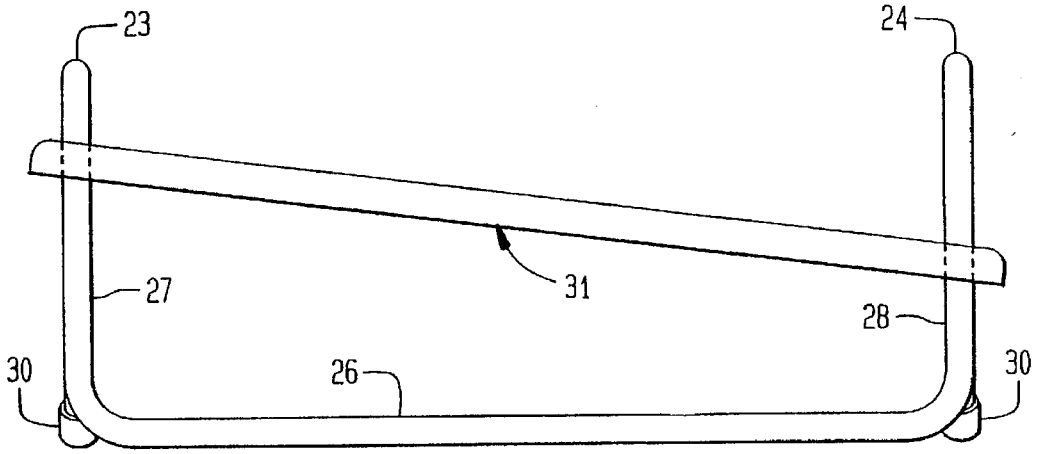
FIG. 8 is a elevational side view corresponding to the assembly shown in FIG. 7.

The footrest 11 also can be adjusted to provide a desired side to side inclination of the platform 13 on the base 15 as shown in FIGS. 7 and 8. A side to side inclination of the platform 13 is obtained by providing in one of the slots 35, 36 a spacing between support pins 48 that is different than the spacing between the support pins 48 in the other slot 35, 36. In addition, by combining the selected variable spacings illustrated in FIGS. 5–8, an inclination (not shown) having both side to side and front to back inclinations can be obtained.

Obviously, many modifications and variations of the present invention are possible in light of the above teachings. It is to be understood, therefore, that the invention can be practiced otherwise than as specifically described.

What is claimed is:

1. A footrest comprising:

frame means including a base portion for placement on a supporting surface, and a standard portion projecting upwardly from said base portion; said standard portion comprising a pair of substantially parallel horizontally spaced apart uprights, and a pair of substantially parallel horizontally spaced apart struts, each said strut having an upper end joined to an upper end of a different one of said uprights by a joining means to form a joined upright and strut pair, and each said joined upright and strut in each said pair sloping upwardly toward each other in a given direction;

platform means defining a substantially planar surface straddled between said joining means and having first and second edge portions disposed adjacent to, respectively, each of said joined upright and strut pair; and support means engaged between each of said edge portions and said adjacent joined upright and strut, each said support means including an upright support engaged and slidable in said given direction between said adjacent upright and said platform means and a strut support spaced apart from said upright support by an adjustable spacing, engaged between said adjacent strut and said platform means and slidable in said given direction, each said support being shaped and arranged to permit separation of said platform means from said frame means; and including adjustment means allowing independent adjustment of said adjustable spacing between each pair of said spaced apart upright and strut supports whereby a vertical position of said platform means on said standard portion can be adjusted.

2. A footrest according to claim 1 wherein each said upright support is an upright support pin and each said strut support is a strut support pin, and said support pins are retained by one of said standard portion or said platform means and movable thereon so as to allow said adjustment of said adjustable spacing.

3. A footrest according to claim 2 wherein said adjustment means comprises for each of said support pins a plurality of spaced apart receptacles for sequentially receiving said support pins.

4. A footrest according to claim 3 wherein said support pins are retained by said platform means and said receptacles are defined thereby.

5. A footrest according to claim 4 wherein said platform means defines a pair of parallel slots each having first and second parallel opposite edges, forming one of said edge portions and receiving one of said joined upright and strut pairs.

6. A footrest according to claim 5 wherein said receptacles comprise for each said support pin a plurality of grooves formed on said platform means along said opposite edges, said grooves on said first opposite edge being aligned with said grooves on said second opposite edge.

7. A footrest according to claim 6 wherein each of said grooves defines a longitudinal opening having a width less than a diameter of said support pin received thereby such that said support pins must be forced into said grooves.

8. A footrest according to claim 7 including an attachment mechanism for securing each of said support pins to said platform means.

9. A footrest according to claim 8 wherein each said attachment mechanism comprises a wire member hinged on said platform means, and each said support pin is movably mounted on one of said wire members.

10. A footrest according to claim 9 wherein said grooves are formed on a side of said platform means opposite to said planar surface.

11. A footrest according to claim 1 wherein said adjustment means permits adjustments that provide one said adjustable spacing between said upright support and said strut support adjacent to said first edge portion, and a different spacing between said upright support and said strut support adjacent to said second edge portion.

12. A footrest comprising:

frame means including a base portion for placement on a supporting surface, and a standard portion projecting upwardly from said base portion; said standard portion comprising a pair of substantially parallel horizontally spaced apart uprights, and a pair of substantially parallel horizontally spaced apart struts, each said strut having an upper end joined to an upper end of a different one of said uprights by a joining means to form a joined upright and strut pair, and each said joined upright and strut in each said pair sloping upwardly toward each other;

platform means defining a substantially planar surface straddled between said joining means and having edge portions disposed adjacent to said joined uprights and struts;

support means engaged between each of said edge portions and said adjacent joined upright and strut, each said support means including an upright support movably engaged between said adjacent upright and said platform means and a strut support spaced apart from said upright support by an adjustable spacing and movably engaged between said adjacent strut and said platform means, each said support being shaped and arranged to permit separation of said platform means from said frame means; and including adjustment means allowing adjustment of said support means whereby the vertical position of said platform means on said standard portion can be adjusted; and restraint means for restraining said separation of said platform means from said frame means.

13. A footrest according to claim 12 wherein each said upright support is an upright support pin and each said strut support is a strut support pin, and said support pins are retained by one of said standard portion and said platform means and movable thereon so as to allow said adjustment of said spacing.

14. A footrest according to claim 13 wherein said adjustment means comprises for each of said support pins a plurality of spaced apart receptacles for sequentially receiving said support pins.

15. A footrest according to claim 14 wherein said support pins are retained by said platform means and said receptacles are defined thereby.

16. A footrest according to claim 15 wherein said platform means defines a pair of slots each having a pair of parallel edges forming one of said edge portions and receiving one pair of a said joined upright and strut.

17. A footrest according to claim 16 wherein said restraint means comprises a pair of projections, one extending from each of said parallel edges of each said edge portion and defining a gap having a given length; and said uprights, struts and joining means are formed by a tube having a uniform diameter greater than said given length such that said tube must be forced through said gap during assembly of said platform means and said frame means.

18. A footrest according to claim 15 wherein said projections and said grooves are formed with a resilient material.

19. A footrest according to claim 12 wherein said restraint means comprises press fitted, engaged portions of, respectively, said platform means and said frame means.

20. A footrest according to claim 12 wherein said adjustment means allows independent adjustment of said adjustable spacing between each pair of said spaced apart upright and strut supports.

* * * * *